US006093165A

United States Patent [19]

Estwanik

[11] Patent Number: 6,093,165

[45] Date of Patent: Jul. 25, 2000

[54] HAND AND WRIST STABILIZATION DEVICE

[76] Inventor: Joseph J. Estwanik, 335 Billingsley Rd., Charlotte, N.C. 28211

[21] Appl. No.: 09/041,334

[22] Filed: Mar. 12, 1998

Related U.S. Application Data

[63] Continuation-in-part of application No. 08/498,884, Jul. 6, 1995, which is a continuation of application No. 29/023,620, May 27, 1994, Pat. No. Des. 367,731.

[51] Int. Cl.[7] ..... A61F 13/00

[52] U.S. Cl. ..... 602/64; 602/21; 2/161.7

[58] Field of Search ..... 602/21, 22, 64; 2/159, 160, 161.1, 161.6, 161.7, 161.2, 16, 18, 20; D2/617; 473/450, 458; 128/878, 879

[56] References Cited

U.S. PATENT DOCUMENTS

| | | | |
|---|---|---|---|
| 4,287,609 | 9/1981 | Amadeo . | |
| 5,014,689 | 5/1991 | Meunchen et al. . | |
| 5,018,221 | 5/1991 | Romandetto . | |
| 5,295,269 | 3/1994 | Ballard . | |
| 5,414,868 | 5/1995 | Crawford | 2/160 |
| 5,435,013 | 7/1995 | Davis | 2/161.1 |
| 5,634,214 | 6/1997 | St. Ville | 2/161.2 |

*Primary Examiner*—Richard J. Apley
*Assistant Examiner*—Kim M. Lee
*Attorney, Agent, or Firm*—Kennedy Covington Lobdell & Hickman, L.L.

[57] ABSTRACT

A hand and wrist stabilization device for disposition on the hand and wrist of a user to reduce relative movement of internal hand elements, specifically, the metacarpophalangeal, carpometacarpal and wrist joints, during impact resulting from striking and punching activities, includes a flexible glove-like body, a metacarpophalangeal joint force dispersion pad attached to the body, an ulnar wrist stabilization strap, a radial wrist stabilization strap, a wrist compression strap attached to the body portion and a metacarpophalangeal joint stabilization member attached to the body all acting together to disperse forces on the hand and wrist joints while stabilizing such joints against internal movement caused by impact transmitted thereto during striking and punching activities.

20 Claims, 15 Drawing Sheets

HAND AND WRIST STABILIZATION DEVICE

CROSS-REFERENCE TO RELATED APPLICATION

This is a continuation in part of co-pending U.S. patent application Ser. No. 08/498,884, filed Jul. 6, 1995, entitled HAND AND WRIST STABLIZATION DEVICE, which is a continuation of U.S. Design patent application Ser. No. 29/023,620, filed May 27, 1994, for HAND WRAP FOR USE IN CONTACT RELATED ACTIVITIES, now U.S. Pat. No. D-367,731.

BACKGROUND OF THE INVENTION

The present invention relates broadly to muscle and joint braces and, more particularly, to a device for stabilizing the hand and wrist of a user while the hand is clenched into a fist for use during activities involving striking or punching with the hand, including for example but without limitation boxing, kickboxing, martial arts, aerobic boxing and kickboxing, law enforcement and military training, and other sports which may include striking with the hands such as football or hockey.

When considering injuries resulting from activities of the aforementioned type, most people think of injuries inflicted by the hand on an opponent or other participant. Nevertheless, even though the hand may be covered by a protective glove, the hand and, more particularly, the metacarpophalangeal (MCP) joints, carpal-metacarpal, carpal-metacarpal and wrist are subject to injury due primarily to displacement or derangement caused by repeated trauma. Hand and wrist injury and reinjury in such activities can be lessened by increasing the application of various safety measures including methods of wrapping and gloving the hands and usage of custom-fit protective devices.

Typically, pads are placed over the knuckles of a participant and taped into place which, if skillfully done, can somewhat strengthen and protect the wrist and hand. However, considerable skill and care must be used when applying the tape which can be a time-consuming and user-dependent process.

Therefore, if the participant desires hand and wrist stabilization and accompanying knuckle or MCP joint protection, a lengthy and time consuming taping process, dependent on the skill and knowledge of the applier, must be undertaken in order properly stabilize the wrist and hand. Even then, the materials currently used for this purpose, i.e., gauze and tape, are archaic and fail to utilize modern biomaterials and biomechanical knowledge and concepts.

SUMMARY OF THE INVENTION

It is accordingly an object of the present invention to provide a hand and wrist stabilization device which is adaptable for most any activity in which punching or striking with the hand is involved and provides swift and sure hand and wrist stabilization.

It is another object of the present invention to provide such a hand and wrist stabilization device that provides enhanced MCP joint stabilization over the current state of the art.

A more specific object of the present invention is to provide a hand and wrist stabilization device for disposition on the hand and wrist of a user either inside an outer glove, e.g. a boxing glove, or as an independent device to reduce relative movement of internal hand elements during impact resulting from competitive boxing, aerobic boxing, martial arts, law enforcement training football, hockey, or other activities that involve striking or punching with the hands.

Briefly summarized, the foregoing objects are achieved in accordance with the present invention by a hand and wrist stabilization device which basically comprises a glove-like body to be worn over a user's hand, with appropriate means being attached to the glove-like body to stabilize the metacarpophalangeal joints of the user's hand with respect to impact forces thereagainst, and with appropriate strap means for securement about the glove-like body to rigidify the user's hand and wrist when the hand is in a fisted condition. More specifically, the glove-like body is basically formed of a flexible material to receive at least a portion of the hand of the user, with a palm portion overlying the palm of the user's hand. The stabilizing means basically comprises an elongate stabilization pad and a flexible web means for attaching the pad to the palm portion at a spacing therefrom generally transversely with respect to the metacarpophalangeal joints of the user's hand. In this manner, the flexible web means enables the user to grip the stabilization pad selectively in differing relative dispositions to the underside of the metacarpophalangeal joints according to the particular preferences and physiology of the individual user.

While various embodiments of the present hand and wrist stabilization device are possible, in a preferred embodiment the glove-like body is adapted to receive the hand and wrist of the user with the fingers and thumb left exposed and, for such purpose, the body includes, in addition to the palm portion, a backhand portion for overlying the back of the user's hand, with the palm portion and the backhand portion defining finger and thumb openings, and a wrist portion for generally encircling the user's wrist. The strap means preferably comprises a pair of straps fixedly attached to opposite sides of the glove-like body adjacent opposite sides of the user's metacarpophalangeal joints and extending away therefrom for respective attachment to opposite sides of the wrist portion, whereby one of the straps functions for radial wrist stabilization to resist radial movement of the wrist during boxing activities and the other of the straps functions for ulnar wrist stabilization to resist ulnar movement of the wrist during boxing activities.

In the preferred embodiment, the strap means for the hand and wrist stabilization device further includes a wrist compression strap having means at one end for securement and support with respect to the user's thumb and an elongate strap body extending therefrom from selective wrapping releasably in a circumferential disposition around the user's wrist.

The preferred form of the hand and wrist stabilization device additionally includes a force dispersion means, preferably in the form of a pad, attached to the backhand portion of the glove-like body to extend across the mettacarpophalangeal joints to disperse impact forces thereagainst. The pad has a profiled configuration generally mated to the shape of the metacarpophalangeal joints of the user to optimize the surface area for enhanced dispersal of impact forces and thereby reduce the transmission of such forces to the metacarpophalangeal joints.

In the preferred embodiment, the pad of the stabilizing means of the hand and wrist stabilization device has a generally rounded cross-sectional configuration and the web means is preferably formed to have a pocket portion for enclosing the pad and a connecting portion extending between the pocket portion and the palm portion of the glove-like body. In this manner, the rounded pad is supported for a limited degree of movement toward and away from the fingers of the user's hand to enable the user to vary the gripping location of the stabilization pad within the fingers and palm area of the hand according to the user's own particular preference or comfort and the user's own individual physical hand shape and size.

DETAILED DESCRIPTION OF THE PREFERRED EMBODIMENT

Figure 1:
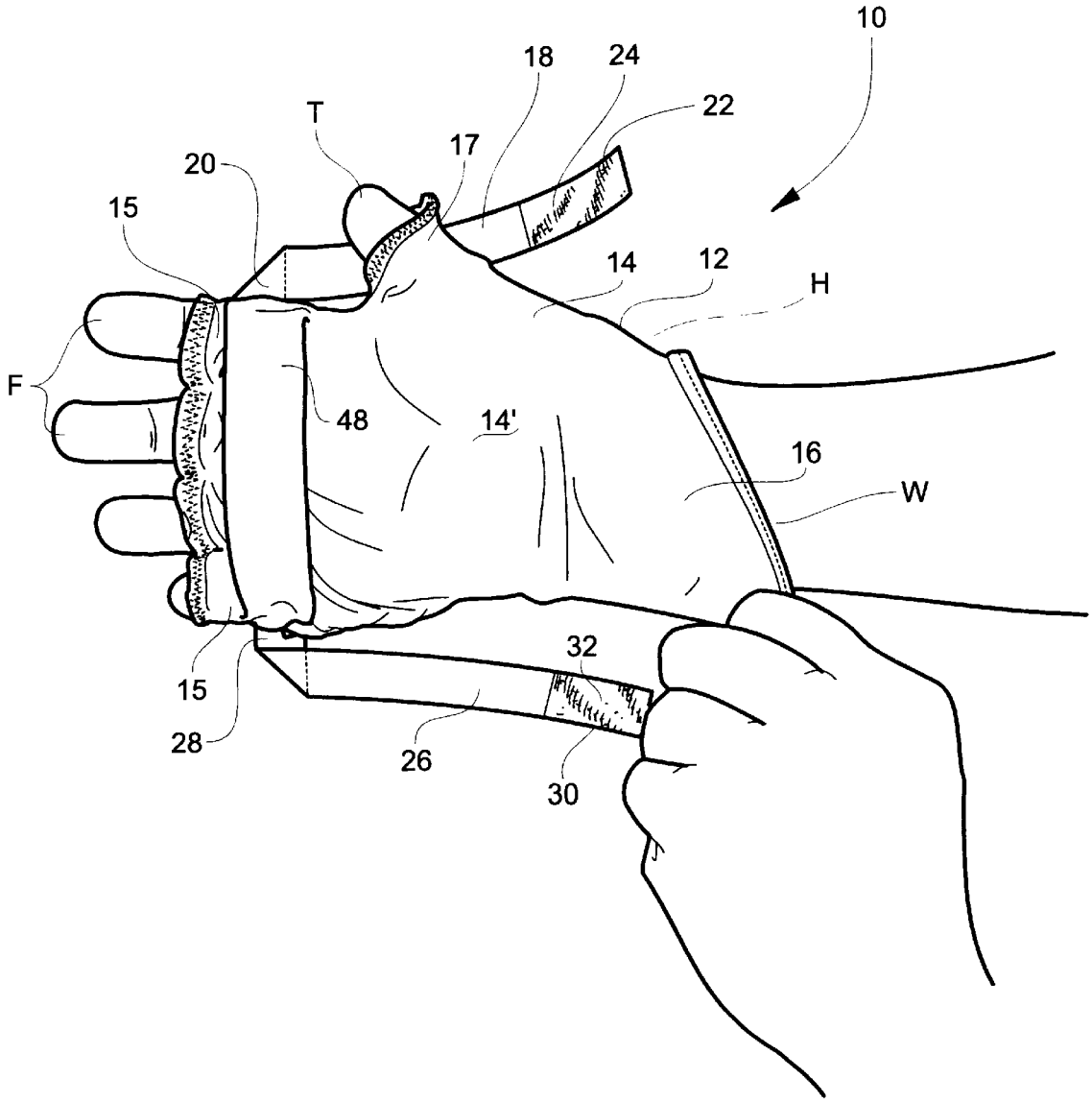
FIGS. 1–12 are perspective views of a hand and wrist stabilization device according to one preferred embodiment of the present invention, depicting sequentially the process of placing and securing the device on a user's hand, FIGS. 1–5, 7, 8, 10 and 11 depicting the device from the palm side of the user's hand, and FIGS. 6, 9, and 12 depicting the device from the back side of the user's hand.

Turning now to the drawings and, more particularly to FIGS. 1–12, a hand and wrist stabilization device is illustrated generally at 10 and basically includes a body 12 for receiving and substantially enveloping the hand and wrist of a user during hand punching, striking and like activities involving handstriking and impact, with associated padding described more fully below, to disperse impact forces and stabilize the hand of the user particularly in the region of the metacarpophalangeal joints, and an arrangement of straps, also more fully described below, for securing the device 10 in place on the user's hand, rigidifying the user's hand and wrist, and helping to maintain the hand in a fisted condition.

The body 12 is basically fabricated in the form of a glove made from a suitably flexible material to conform to the shape of a user's hand. The glove-like body 12 has a hand portion 14 which covers the major portions of a user's hand while leaving the fingers and thumb exposed, including a palm portion 14' to overlie the user's palm and a backhand portion 14" to overlie the back of the user's hand, sewn together to define a hand receiving interior and open finger and thumb channels 15, 17 respectively, for extension therethrough of the user's fingers and thumb, the palm and backhand portions merging into a wrist portion 16 defining an entrance opening into the interior of the body and adapted to encircle the user's wrist and a portion the user's forearm slightly beyond the wrist area when worn.

Figure 6:
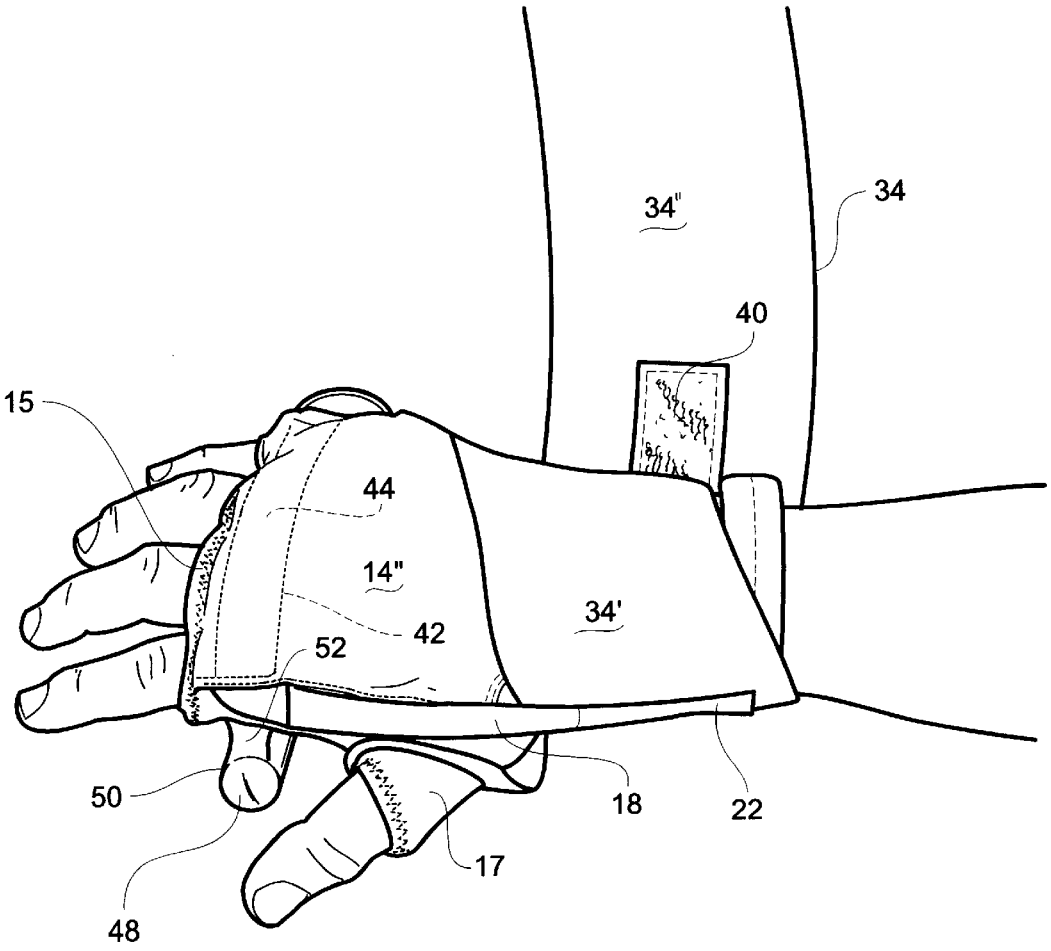

A generally oval-shaped force dispersion pad 42 (see also FIGS. 13–15) is mounted to the backhand portion 14" of the hand portion 14 in an appropriate location to extend laterally or transversely across the metacarpophalangeal (MCP) joints of the user's hand when worn. As seen in FIG. 6, the force dispersion pad 42 is contained within a receiving pocket 44 in the backhand portion 14", which may either be sewn closed to permanently secure the pad 42 in place or may be openable to allow interchangeable force dispersion pads of various thicknesses, configurations or materials to be inserted into the receiving pocket 44.

Figure 13:
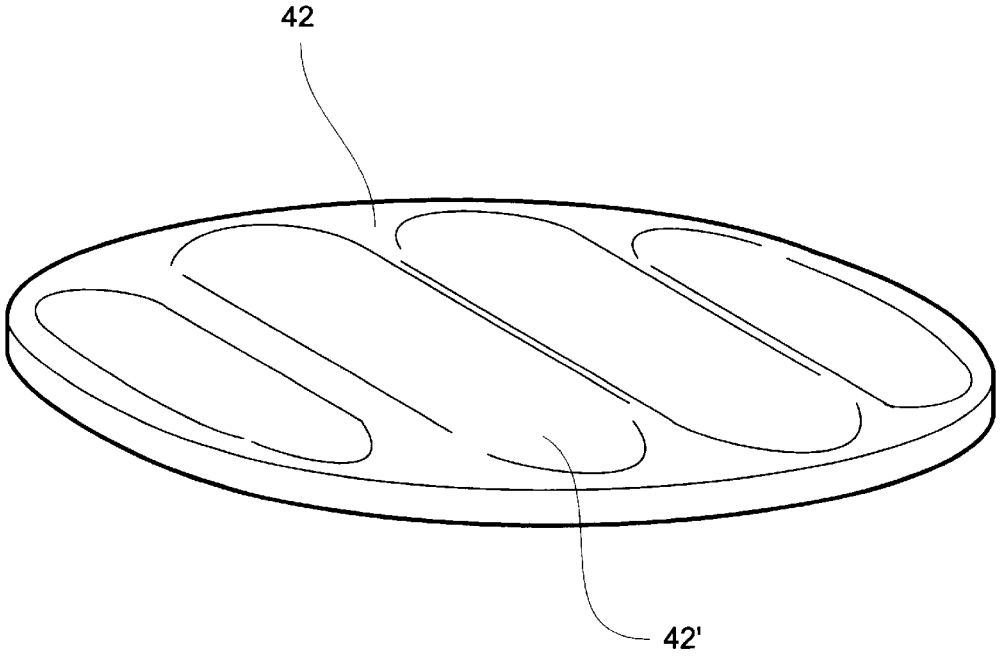
FIG. 13 is a perspective view of the force dispersion pad utilized in the device of FIGS. 1–12.
Figure 14:
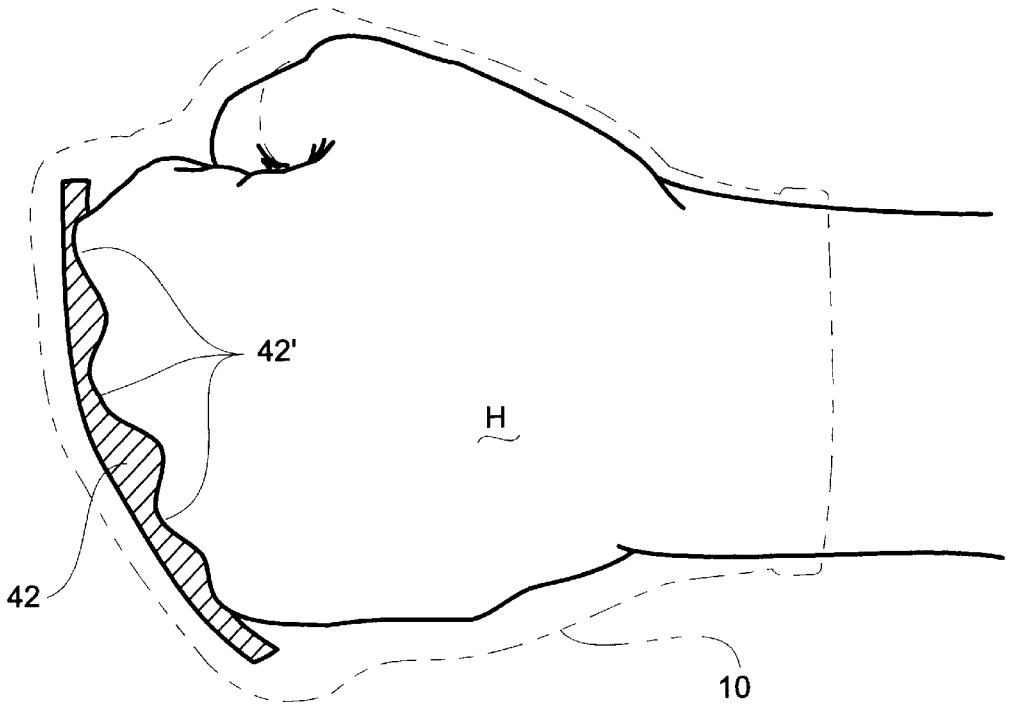
FIG. 14 is a top plan view depicting in phantom lines the hand and wrist stabilization device of FIGS. 1–12 as worn on a user's hand in a fisted condition, showing the conformance of the force dispersion pad to the metacarpophalangeal joints of the hand.
Figure 15:
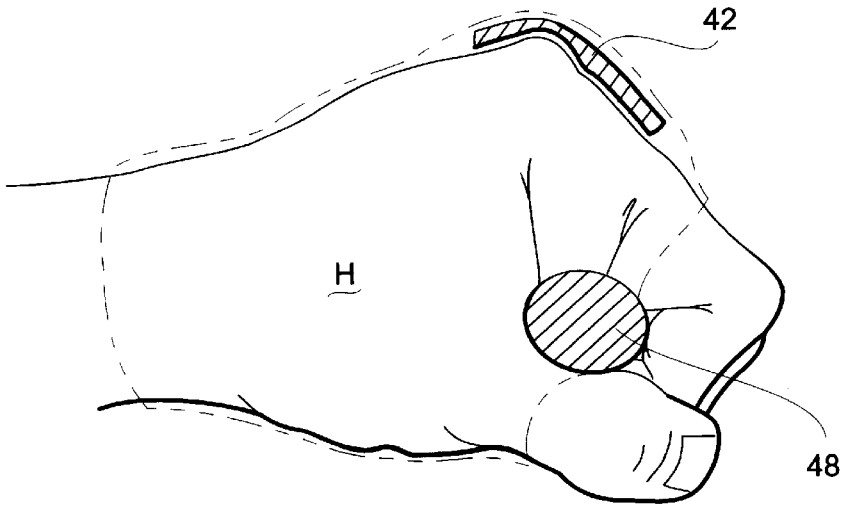
FIG. 15 is a side view depicting in phantom lines similar to FIG. 14 the hand and wrist stabilization device of FIGS. 1–12 as worn by a user with the hand in a fisted condition, showing the conformance of the force dispersion pad to the metacarpophalangeal joints of the hand and also showing the gripped disposition of the stabilization pad within the palm of the hand.

A preferred configuration and construction of the force dispersion pad 42 is depicted in FIGS. 13–15. The pad may be preferably formed either as a molded and shaped foam pad or as a pad having an interior gel or liquid-filled pocket, but in either case, the force dispersion pad 42 is formed into a configuration shaped and configured to at least generally conform in shape to the configuration of the metacarpophalangeal joints of a user's hand. For example, as shown in FIG. 13, the force dispersion pad 42 may be configured with a series of four laterally adjacent depressions 42', adapted when the device 10 is worn, to receive and essentially conform to the individual joints of the wearer's hand, as depicted in FIGS. 14 and 15.

A radial wrist stabilization strap 18 is formed as a flexible elongate member having one longitudinal end forming a mounted strap end portion 20 which is attached to the hand portion 14 at a location which, when worn is disposed adjacent the metacarpophalangeal joints of the hand at the thumb side of the hand portion 14 generally at the juncture of the palm and backhand portion 14', 14", thereof and extends therefrom outwardly with respect to the glove-like body 12 to a distal strap end portion 22 forming a free end of the strap 18. The radial wrist stabilization strap 18 is formed of flexible yet relatively non-stretchable material, e.g., a textile fabric.

An ulnar wrist stabilization strap 26 formed as a flexible elongate member similar to the radial wrist stabilization strap 18 has one end forming a mounted strap end portion 28 attached to the hand portion 14 at the opposite side thereof, adjacent the metacarpophalangeal joints at the juncture between the palm and backhand portions 14', 14", and extending outwardly therefrom to a distal strap end portion forming a free end of the strap 26. The ulnar wrist stabilization strap 26 is also preferably formed of a flexible nonstretchable textile or like material.

As seen in FIGS. 3–7, an elongate wrist compression strap 34 is attachable to the glove-like body for wrapping the wearer's wrist (as more fully described below). The wrist compression strap 34 has one longitudinal end 36 formed with a thumb receiving opening 36' adapted to be placed over the thumb channel 17 when the body 13 is worn, so as to encircle the user's thumb and to extend outwardly away from the body 12. The wrist compression strap 34 has a sufficient extending length to permit wrapping about the wearer's wrist and securement thereto as described below. The wrist compression strap 34 may include extra padding which may be continued to substantially conform to the shape of the wrist and hand of the wearer. The wrist compression strap 34 may also be formed to be thicker at the radial side of the writs for added support.

All three straps may be anchored securely at the wrist portion 16 of the glove-like body 12 preferably by mating hook-and-loop type fastener components. One component 24 of a hook-and-loop fastener assembly, e.g. the so-called male component, is attached to the distal end 22 of the radial wrist stabilization strap 18, and likewise one hook-and-loop fastener component 32, also preferably a male component, is attached to the distal end portion 30 of the ulnar wrist stabilization strap 26. The wrist compression strap 34 is sufficiently longer than the circumference of the wrist portion 14, thereby to wrap around the wrist portion to overlap itself at least once, as seen progressively in FIGS. 3–7. Substantially the entirety of the side 34' of the wrist compression strap 34 which faces outwardly away from the glove-like body 12 when attached over the thumb channel 17 thereof is fabricated as or covered by a so-called female component 40 of a hook-and-loop fastener assembly matable with the male components 24, 32 of the two wrist straps 18, 26. The opposite side 34" of the wrist compression strap 34 has affixed thereto additional male fastener components at strategically selected locations to secure the wrist compression strap 34 when wrapped about the wearer's wrists, e.g. one or more male fastener components 40 at an intermediate location or locations along the wrist compression strap 34, and a main male fastener component 41 at the distal free end portion 38 of the wrist compression strap 34. The attachment of the respective fastener components with respect to one another will be described below. As will be appreciated by those skilled in the art, the hook-and-loop type fastener is preferred for its ease of use but other types of fasteners, such as snaps, may be used without departing from the spirit and scope of the present invention.

Figure 16:
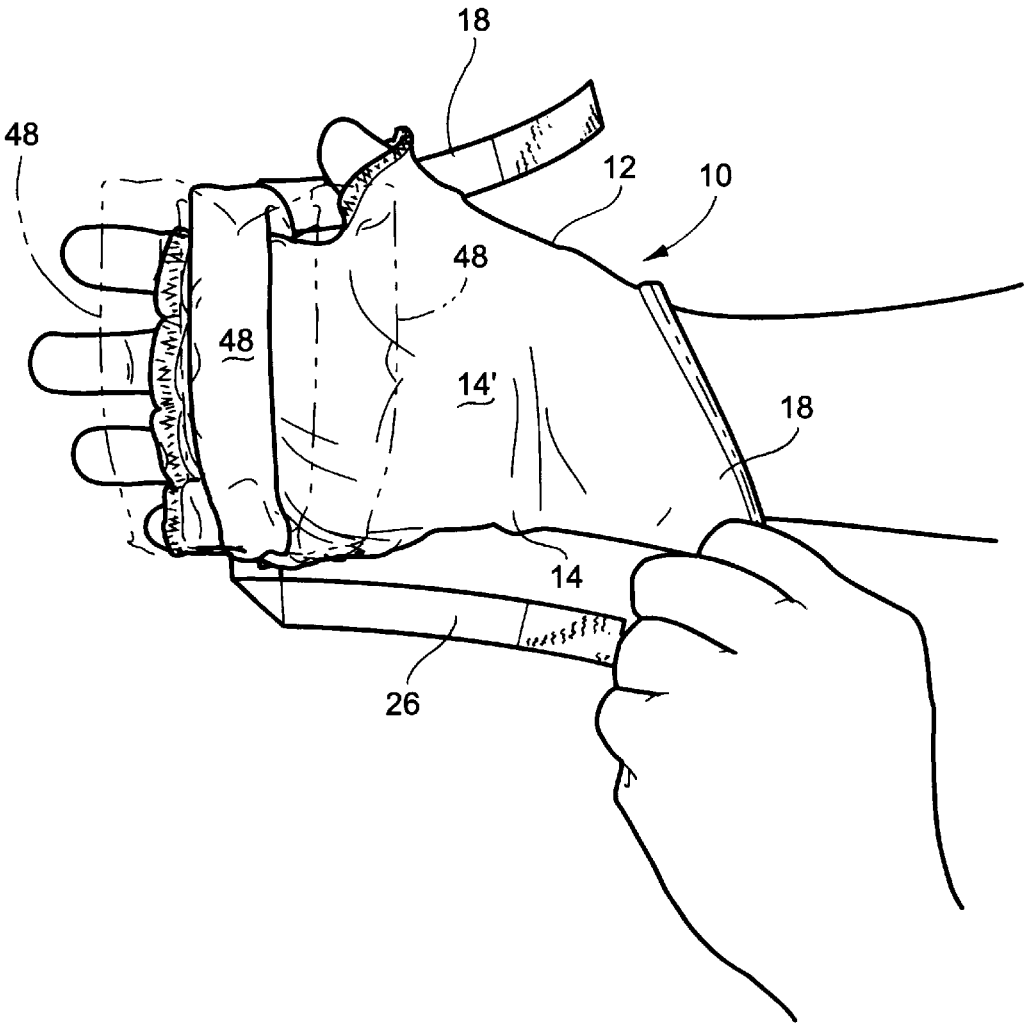
FIG. 16 is another perspective view, similar to FIG. 1, depicting the moveability of the stabilization pad relative to the palm portion of the device and, in turn, relative to the fingers and palm of the user's hand.

With reference to FIGS. 1–9, a metacarpophalangeal joint stabilization member 48 is formed as a generally cylindrical, padded member and is attached to the palm portion 14' of the hand portion 14 to extend transversely along the underside of the metacarpophalangeal joints of the hand H of the user. Although not depicted herein, it should be understood that the metacarpophalangeal joint stabilization member 48 may be molded or otherwise formed with a hand-shaped contour. As best seen and understood with reference to FIGS. 6 and 9, the joint stabilization member 48 is enclosed within a pocket 50 formed of flexible material like that of the glove-like body 12 into a shape defining a pocket interior conforming substantially to the stabilization member 48 for containment thereof and having a web-like connecting portion 52 extending from the pocket 50 and sewn or otherwise attached to the palm portion 14" to support the joint stabilization member 48 at a spacing from the palm portion 14". By means of the web-like connecting portion 42, the disposition of the joint stabilization member 48 relative to the palm portion 14' and in particular, relative to the user's hand especially the metacarpophalangeal joints, when the body 12 is worn, may be selectively shifted and adjusted toward the fingers or wrist according to the preferences and physiology of the user, as depicted in full and broken lines in FIG. 16.

Figure 2:
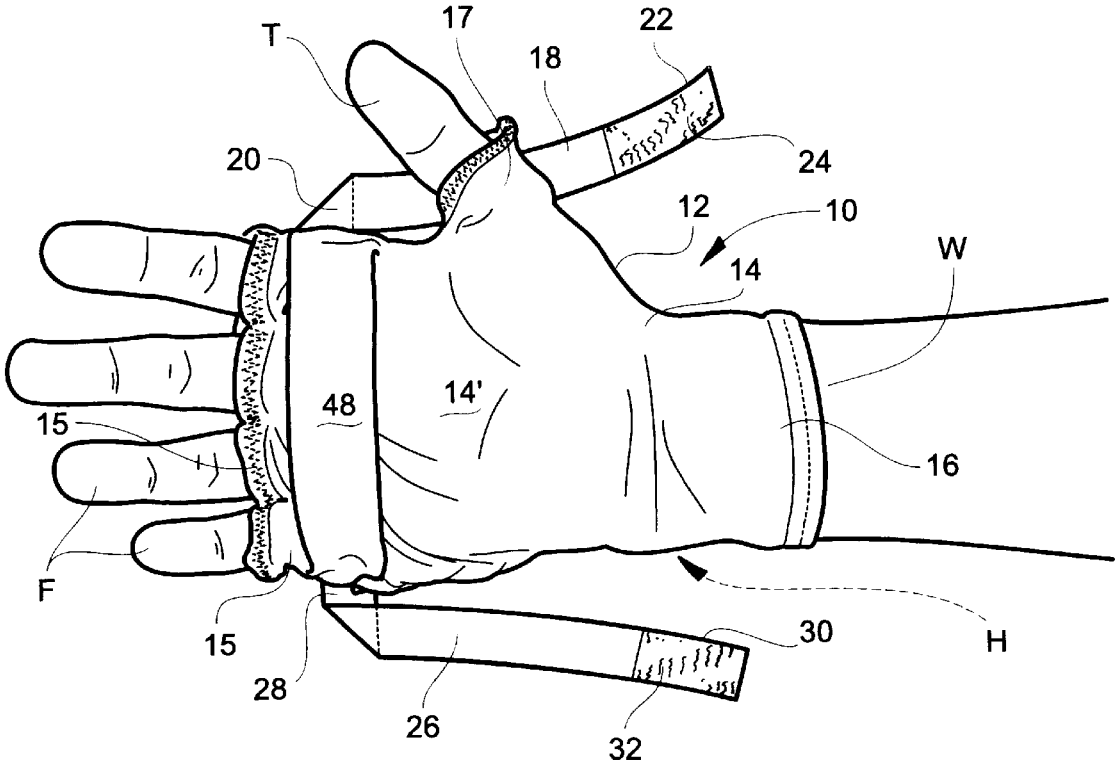
Figure 3:
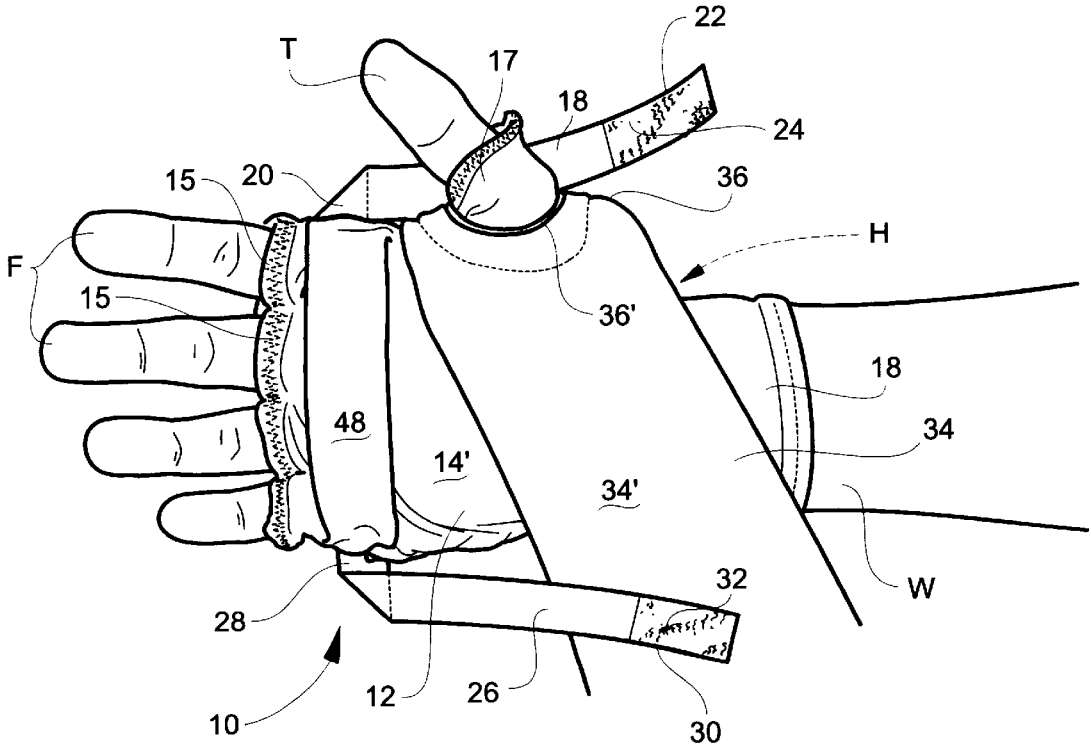

Operation of the device may thus be understood with reference to FIGS. 1–12 illustrating the sequential steps of placing and securing the device 10 onto a user's hand H. As shown in FIGS. 1 and 2, the glove-like body 12 of the device 10 is initially placed onto the user's hand H by inserting the fingers of the hand through the entrance opening defined by the wrist portion 16 and then inserting the fingers and thumb of the hand through the respective finger and thumb channels 15, 17, in essentially the same manner as any glove would be worn. The wrist compression strap 34 is next placed onto the wearer's hand by slipping the thumb receiving opening 36' at one end thereof over the wearer's thumb and then over the thumb channel 17 of the glove-like body, as shown in FIG. 3. As thusly placed onto the wearer's hand, the wrist stabilization straps 18, 26 and the wrist compression strap 34 hang loose with their respective free ends unattached.

Figure 4:
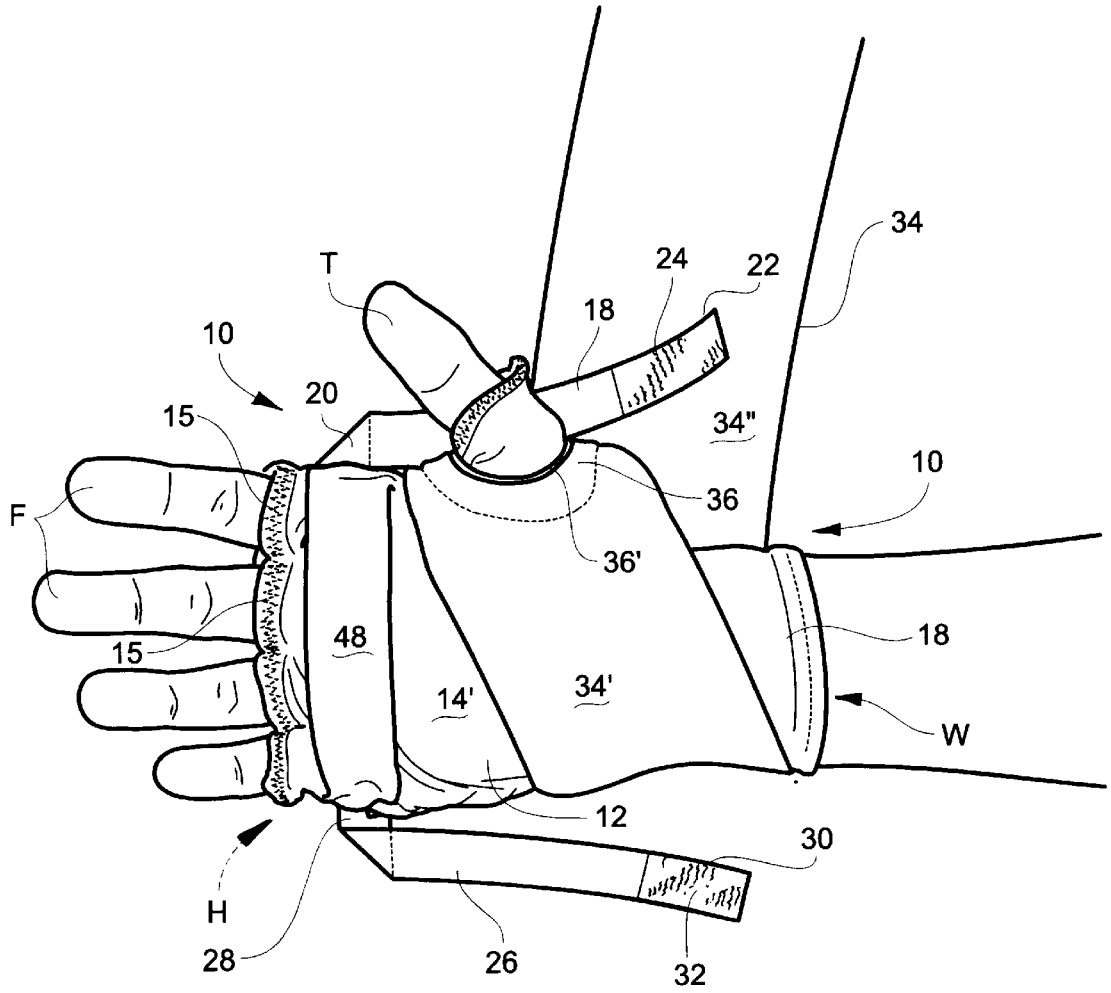
Figure 5:
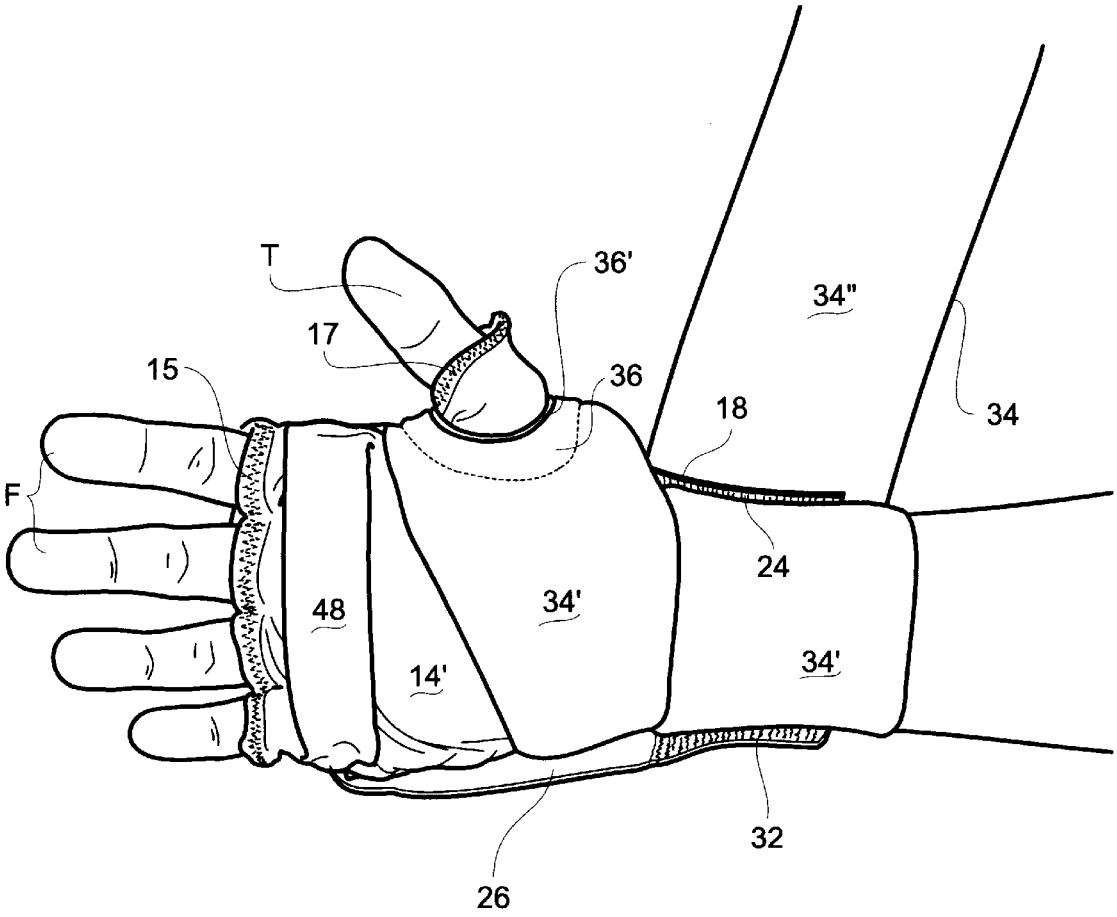

As shown in FIG. 4, the wrist compression strap 34 is then pulled tautly away from the wearer's thumb toward the heel portion at the opposite side of the wearer's hand to begin wrapping the compression strap 34 about the wearer's wrist. After completion of the first full wrapping of the wrist compression strap 34 about the wearer's wrist (FIG. 5), at least one of the male fastener components 40 at the opposite side 34" of the wrist compression strap 34 overlaps and engages the outwardly facing female fastener surface of the wrist compression strap 34, as shown in FIG. 6, to secure the first wrapping of the strap 34 about the wearer's wrist with the wrist compression strap 34 thereby held in a taut condition, the free end portions 22, 30 of the respective radial and ulnar wrist stabilization straps 18, 26 are pulled tautly toward the respective opposing radio and ulnar sides of the wearer's wrist and the respective male fastener components 24, 32 are placed securely against the female fastener component at the outwardly facing side of the wrist compression strap 34, thereby to secure the stabilization straps 18, 26 to the wrist compression strap 34.

Figure 7:
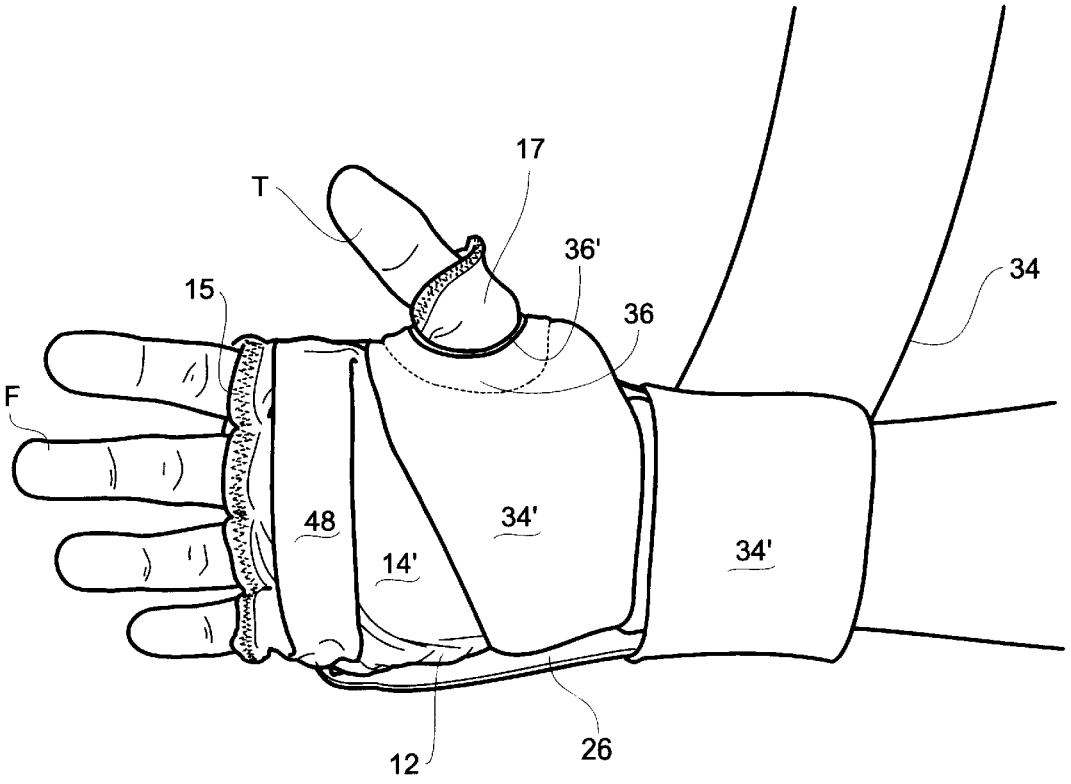
Figure 8:
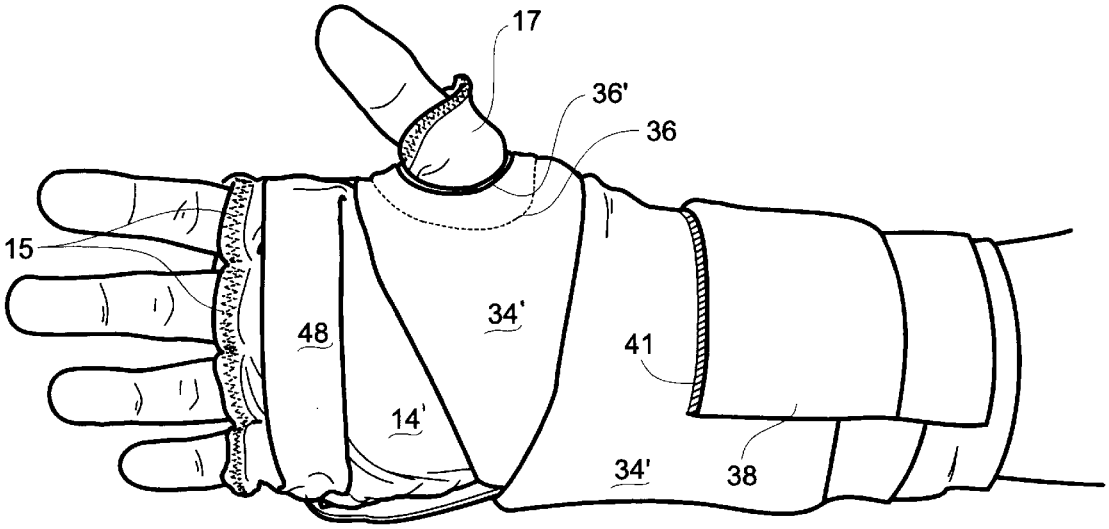

As the remaining length of the wrist compression strap 34 is wrapped about the wearer's wrist, the attached end portions 22, 30 of the wrist stabilization straps 18, 26 are covered by the wrist compression strap 34, supplementing the anchoring and securement of the stabilization straps 18, 26, as depicted in FIG. 7. When the wrist compression strap 34 has been fully wrapped about the wearer's wrist, the male fastener component 41 at the free end portion 38 of the strap 34 overlaps and is thereby secured to the outwardly facing female fastener surface of the previous wrapping of the wrist compression strap 34, as shown in FIG. 8.

Figure 9:
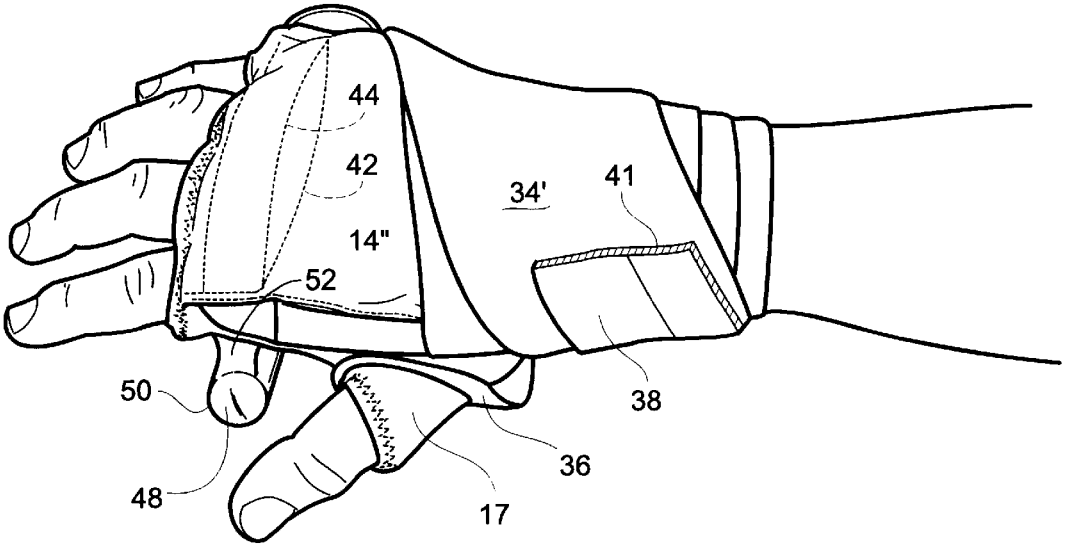
Figure 10:
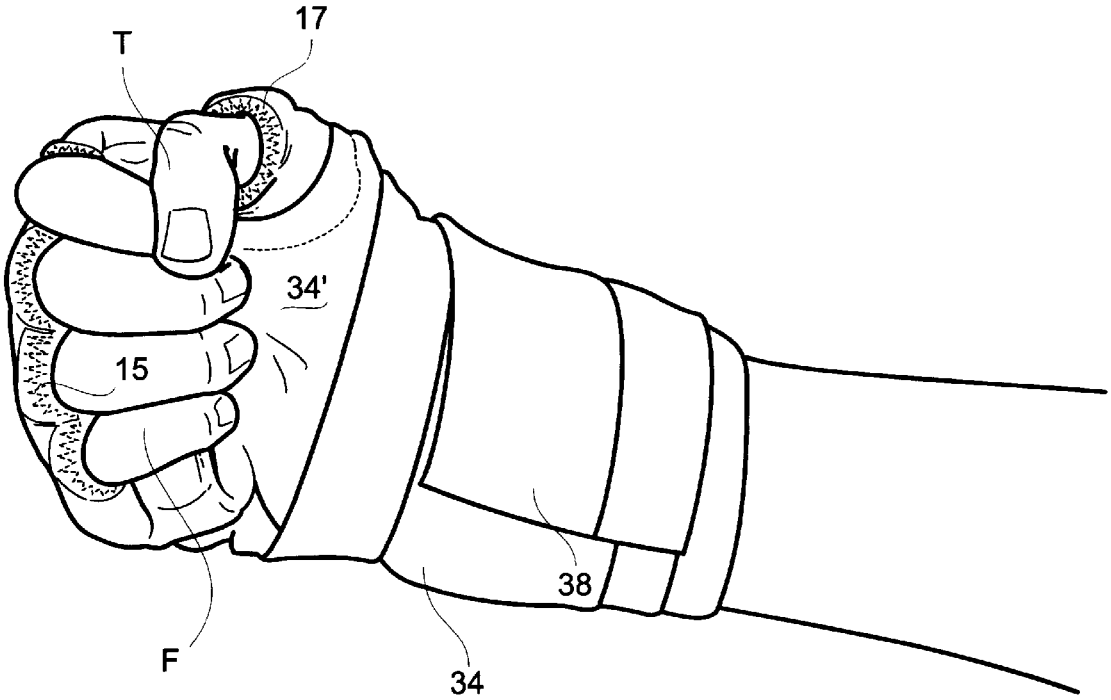
Figure 11:
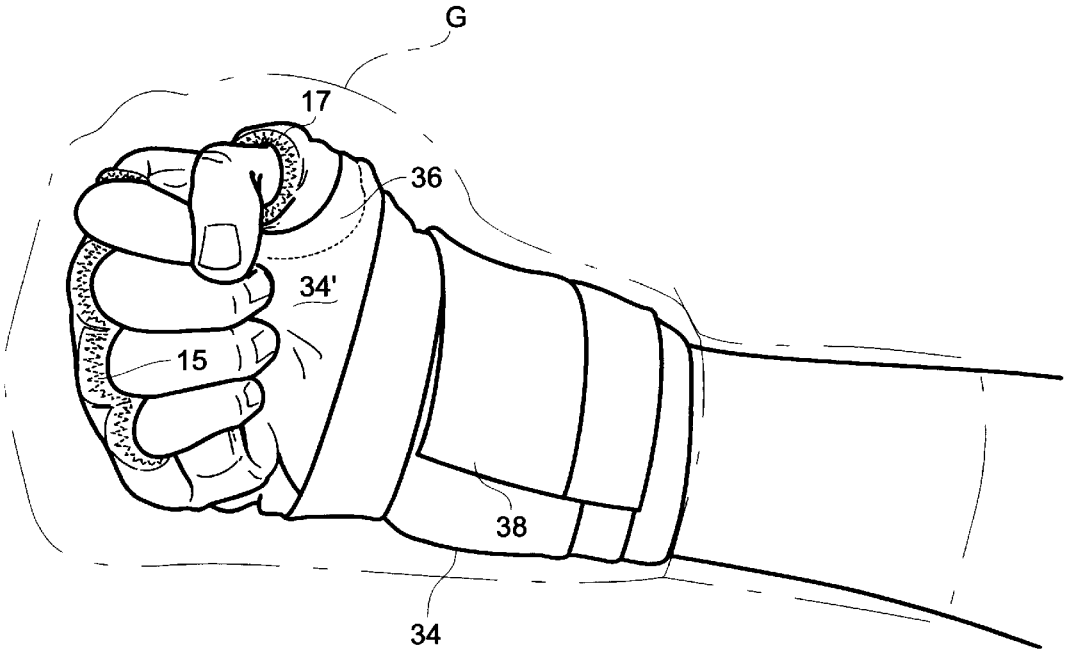
Figure 12:
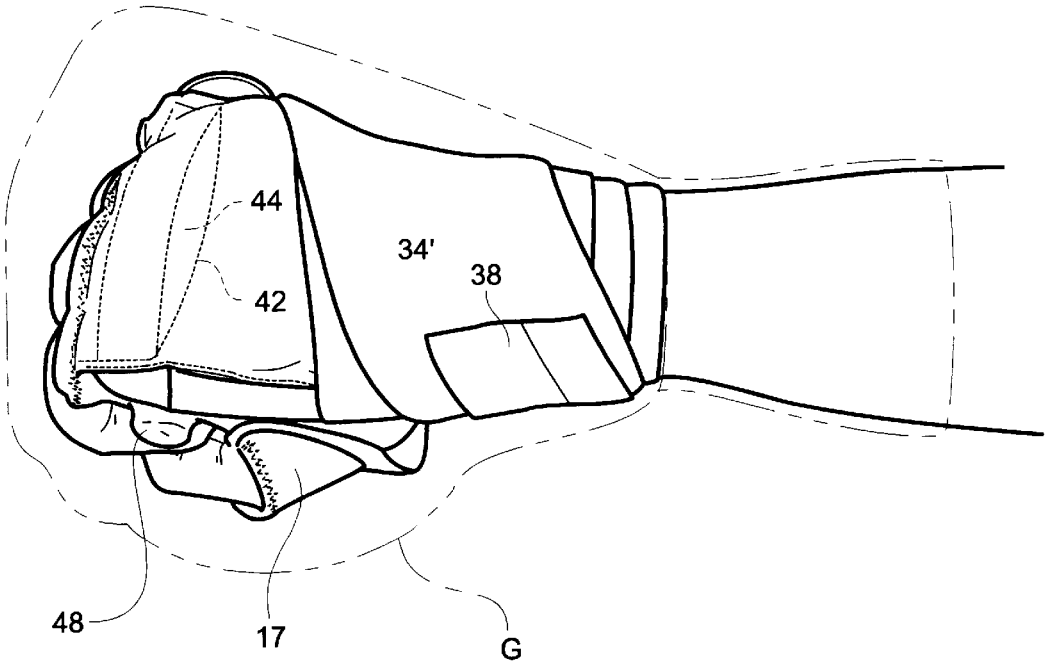

As depicted in FIG. 9, with the device 10 thusly placed on the wearer's hand H and with the respective straps 18, 26, 34 secured so as to stabilize and essentially rigidify the hand relative to the wrist, the metacarpophalangeal joint stabilization member 48 is disposed at a spacing relative to the palm portion 14' by the web-like connecting portion 52. Thus, the joint stabilization member 48 may be shifted forwardly toward the user's fingers or rearwardly toward the heel of the user's hand within a limited range of movement permitted by the web-like connecting portion 52, whereby the user can make fine adjustments in the disposition of the stabilization member 48 relative to the metacarpophalangeal joints as may be necessary or desirable to suit the comfort or other preferences of the user according to his or her own particular hand physiology. In turn, when the user closes his or her fingers and thumb into a fisted condition as shown in FIG. 10, the metacarpophalangeal joint stabilization member 48 is optimally disposed relative to such joints to provide maximum stability to the joints as the hand is used for striking, punching or the like during activities such as boxing, martial arts, law enforcement and military training, football, etc.

As will be understood from the above, the combination of this stabilization member 48 with the wrist stabilization and compression straps 18, 26, 34 acts to prevent or at least reduce relative movement of the internal hand elements, particularly the metacarpophalangeal joints, under forces due to impact during striking and punching activities. The force dispersion pad 42 acts in concert with the stabilization straps 18, 26, 34 to protect the hand by relieving and thereby reducing the force at each metacarpophalangeal joint. By way of example but without limitation, the device of the present invention does not inhibit the ability of a wearer's hand inserted into a boxing glove G (FIGS. 11 and 12) to be used for boxing or like activities, although as will be understood, the device is not limited to such uses and may be used independently of any outer covering in many other activities. Ultimately, the device of this invention therefore provides an easy-to-use and effective method for protecting the hands during such activities which will substantially reduce hand injury for those engaged in such activities.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

I claim:

1. A hand and wrist stabilization device for disposition on the hand and wrist of a user to reduce risk of hand and wrist injuries due to relative movement of internal hand elements during impact resulting from boxing activities involving striking and punching with the hand, said device comprising:

a glove body formed of flexible material for receiving at least a portion of the hand of the user, said body including a palm portion for overlying the palm of the user's hand;

means for stabilizing the metacarpophalangeal joints of the user's hand with respect to impact forces thereagainst, said stabilizing means comprising an elongate stabilization pad and flexible web means for attaching said pad to said palm portion at a spacing therefrom generally transversely with respect to the metacarpophalangeal joints of the user's hand for gripping of said pad by the user in selective relative dispositions to the underside of the metacarpophalangeal joints; and strap means for selective securement about said body for rigidifying the user's hand and wrist and maintaining the user's hand in a fisted condition.

2. A hand and wrist stabilization device according to claim 1, wherein said pad of said stabilizing means comprises a generally rounded cross-sectional configuration and said web means comprises a pocket portion for enclosing said pad and a connecting portion extending between said pocket portion and said palm portion of said body.

3. A hand and wrist stabilization device according to claim 1, wherein said strap means comprises a pair of straps fixedly attached to opposite sides of said body adjacent opposite sides of the user's metacarpophalangeal joints and means for selectively attaching said straps respectively to the body adjacent opposite sides of the user's wrist.

4. A hand and wrist stabilization device according to claim 3, wherein said strap means further comprises a wrist compression strap for selective wrapping releasably in a circumferential disposition around the user's wrist.

5. A hand and wrist stabilization device according to claim 4, wherein said wrist compression strap comprises means at one end for securement and support with respect to the user's thumb and an elongate strap body extending therefrom to extend circumferentially about the user's wrists.

6. A hand and wrist stabilization device according to claim 3, wherein said body includes a wrist portion for generally encircling the wrist of the user and one of said straps forms a radial wrist stabilization strap extending away from the metacarpophalangeal joints of the user for securement at said wrist portion to resist radial movement of the wrist during boxing activities.

7. A hand and wrist stabilization device according to claim 6, wherein the other of said straps forms an ulnar wrist stabilization strap extending away from the metacarpophalangeal joints of the user for securement at said wrist portion to resist ulnar movement of the wrist during boxing activities.

8. A hand and wrist stabilization device for disposition on the hand and wrist of a user internally of a boxing glove to reduce risk of hand and wrist injuries due to relative movement of internal hand elements during impact resulting from boxing activities, said device comprising:

a glove body formed of flexible material for receiving the hand and wrist of a user with the fingers and thumb exposed, said body including a palm portion for overlying the palm of the user's hand, a backhand portion for overlying the back of the user's hand, the palm portion and the backhand portion defining finger and thumb openings, and a wrist portion for generally encircling the user's wrist;

a metacarpophalangeal joint force dispersal pad attached to said backhand portion and extending transversely across the metacarpophalangeal joints of the user's hand for dispersal of impact forces thereagainst to reduce transmission of impact forces to the metacarpophalangeal joints;

a pair of straps fixedly attached to opposite sides of said body adjacent opposite sides of the user's metacarpophalangeal joints and extending away therefrom for respective attachment to opposite sides of said wrist portion; and means for stabilizing the metacarpophalangeal joints of the user's hand with respect to impact forces thereagainst, said stabilizing means comprising an elongate stabilization pad and flexible web means for attaching said pad to said palm portion at a spacing therefrom generally transversely with respect to the metacarpophalangeal joints of the user's hand for gripping of said pad by the user in selective relative dispositions to the under side of the metacarpophalangeal joints; and a wrist compression strap for selective wrapping releasably in a circumferential disposition around the said wrist portion.

9. A hand and wrist stabilization device according to claim 8, wherein said pad of said stabilizing means comprises a generally rounded cross-sectional configuration and said web means comprises a pocket portion for enclosing said pad and a connecting portion extending between said pocket portion and said palm portion of said body.

10. A hand and wrist stabilization device according to claim 8, wherein said wrist compression strap comprises means at one end for securement with respect to the user's thumb and an elongate strap body extending therefrom to extend circumferentially about the user's wrists.

11. A hand and wrist stabilization device according to claim 8, wherein said body includes a wrist portion for generally encircling the wrist of the user and one of said straps forms a radial wrist stabilization strap extending away from the metacarpophalangeal joints of the user for attachment to said wrist portion to resist radial movement of the wrist during boxing activities.

12. A hand and wrist stabilization device according to claim 8, wherein the other of said straps forms an ulnar wrist stabilization strap extending away from the metacarpophalangeal joints of the user for attachment to said wrist portion to resist ulnar movement of the wrist during boxing activities.

13. A hand and wrist stabilization device according to claim 8, wherein said force dispersion pad comprises a profiled configuration generally mated to the metacarpophalangeal joints of the user.

14. A hand and wrist stabilization device for disposition on the hand and wrist of a user to reduce risk of hand and wrist injuries due to relative movement of internal hand elements during impact resulting from boxing activities involving striking and punching with the hand, said device comprising:

a glove body formed of flexible material for receiving at least a portion of the hand of the user, said body including a palm portion for overlying the palm of the user's hand and a backhand portion for overlying the back of the user's hand;

strap means for selective securement about said body for rigidifying the user's hand and wrist; and force dispersion means attached to said backhand portion of said body extending across the metacorpophalangeal joints for dispersal of impact forces thereagainst.

15. A hand and wrist stabilization device according to claim 14 wherein said force dispersion means comprises a pad configured to conform to the metacarpophalangeal joints of the user.

16. A hand and wrist stabilization device according to claim 15, wherein said pad comprises a profiled configuration generally mated to the metacarpophalangeal joints of the user.

17. A hand and wrist stabilization device according to claim 14, wherein said strap means comprises a pair of straps fixedly attached to opposite sides of said body adjacent opposite sides of the user's metacarpophalangeal joints and means for selectively attaching said straps respectively to the body adjacent side of the user's wrist.

18. A hand and wrist stabilization device according to claim 17, wherein said strap means further comprises a wrist compression strap for selective wrapping releasably in a circumferential disposition around the user's wrist.

19. A hand and wrist stabilization device according according to claim 18, wherein said wrist compression strap comprises means at one end for securement and support with respect to the user's thumb and an elongate strap body extending therefrom to extend circumferentially about the use's wrists.

20. A hand and wrist stabilization device according to claim 17, wherein said body includes a wrist portion for generally encircling the wrist of the user, one of said straps forming a radial wrist stabilization strap extending away from the metacarpophalangeal joints of the user for securement at said wrist portion to resist radial movement of the wrist during boxing activities, and the other of said straps forming an ulnar wrist stabilization strap extending away from the metacarpophalangeal joints of the user for securement at said wrist portion to resist ulnar movement of the wrist during boxing activities.

* * * * *